US006236154B1

(12) United States Patent
Kroon et al.

(10) Patent No.: US 6,236,154 B1
(45) Date of Patent: May 22, 2001

(54) ELECTRON TUBE WITH A CESIUM SOURCE

(75) Inventors: Ron Kroon; Tom Van Zutphen; Frederik C Gehring, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/261,985

(22) Filed: Mar. 4, 1999

(30) Foreign Application Priority Data

Mar. 4, 1998 (EP) ..... 98200690

(51) Int. Cl.[7] ..... H01J 29/00; H01J 29/04

(52) U.S. Cl. ..... 313/446; 313/447

(58) Field of Search ..... 313/446, 452, 313/447, 495, 542, 544

(56) References Cited

U.S. PATENT DOCUMENTS

| | | | | |
|---|---|---|---|---|
| 4,460,831 | * | 7/1984 | Oettinger et al. | 313/542 |
| 4,874,987 | * | 10/1989 | Van Der Eijk et al. | 313/544 |
| 4,970,392 | * | 11/1990 | Oettinger et al. | 313/542 |
| 5,444,328 | | 8/1995 | Van Zutphen | 313/446 |
| 5,898,269 | * | 4/1999 | Baum et al. | 313/542 |
| 5,932,966 | * | 8/1999 | Schneider et al. | 313/542 |

* cited by examiner

*Primary Examiner*—Michael H. Day

(57) ABSTRACT

In an electron tube based on a cold cathode, a cesium source (17) containing $Cs_x$—$Au_y$ or $Cs_x$—$Sb_y$ is provided near the cold cathode (7), preferably in contact with the first grid (9). Cesium is introduced into the source during activation of the tube. The vapor pressure of the cesium compounds is such that proper delivery of cesium is guaranteed throughout the life-time of the cathode.

9 Claims, 2 Drawing Sheets

ELECTRON TUBE WITH A CESIUM SOURCE

BACKGROUND OF THE INVENTION

The invention relates to an electron tube provided with a cathode structure for emitting electrons, which is arranged on a support.

The electron tube can be used as a display tube or a camera tube but may also be embodied so as to be used for electrolithographic applications or electron microscopy.

An electron tube of the above-mentioned type is shown in U.S. Pat. No. 5,444,328. In a so-called "cold cathode", a pn junction is operated in reverse bias in such a manner that avalanche multiplication of charge carriers occurs. In this process, electrons may receive sufficient energy to exceed the work function potential. The emission of the electrons is further enhanced by the presence of a work function potential-reducing material, in particular cesium.

The use of cesium as the work function potential-reducing material often causes problems. For example, cesium is sensitive to the presence (in the operating environment) of oxidizing gases (such as water vapor, oxygen, $CO_2$). In addition, cesium has a high vapor pressure so that it vaporizes readily. Dissipation of the cathode causes the cesium to be lost as a result of an increase in temperature. In addition, ESD (Electron Stimulated Desorption) occurs; the electrons emitted by the cathode induce desorption of the cesium, in particular from slightly oxidized surfaces. This loss of cesium causes the electron-emission coefficient of the cathode to decrease during its life-time, resulting in a substantial reduction of said life-time.

OBJECT AND SUMMARY OF THE INVENTION

The invention aims, inter alia, at solving one or more of the above problems.

To achieve this, an electron tube in accordance with the invention is characterized in that a cesium source is situated in a space between the support and a grid electrode, which cesium source comprises an alloy of one or more of the combinations cesium-gold, cesium-antimony or cesium-gold-antimony.

Preferably, the cesium source is situated in the space between the support and the grid electrode opposite said support.

The source is obtained by providing (in the vicinity of the cathode structure) for example a layer of gold or antimony. The gold-cesium (antimony-cesium) alloy is obtained during the manufacture of the electron tube, in that a primary cesium source, for example a cesium-chromate dispenser, provides the cathode structure with the necessary cesium. The cesium atomized by this source also deposits elsewhere and combines with the gold (antimony) to form a cesium-gold-compound (antimony-gold-compound). The cesium delivery by the source thus obtained takes place by evaporation; if this occurs at a temperature which is substantially equal to that of the cathode, sufficient dispensation takes place. In this case, the cesium source does not have to be provided with heating means.

The supply of cesium by means of the cesium-chromate dispenser preferably takes place only in the production stage because it requires a high heating temperature involving high currents which, for use during the service life, lead to an unacceptable energy consumption for the consumer.

To obtain an accurate delivery of cesium, preferably, the cesium source is provided as a thin layer on the side of a grid electrode facing the cathode structure, which grid electrode is situated opposite the support.

To ensure the cesium supply for a sufficiently long period of time, the thickness of the layer ranges between 0.1 $\mu$m and 10 $\mu$m. The cesium source has a maximum diameter of 10 mm, and preferably 2 mm, to bring about an accurate delivery and efficient absorption of the cesium in the source.

Accelerated delivery of cesium also takes place in the case of excessive heating. Thus, to regulate the delivery, if necessary, the compound or alloy is at least partly surrounded by a layer which is practically impenetrable to cesium, such as platinum.

These and other aspects of the invention will be apparent from and elucidated with reference to the embodiments described hereinafter.

DESCRIPTION OF THE PREFERRED EMBODIMENT

Figure 1:
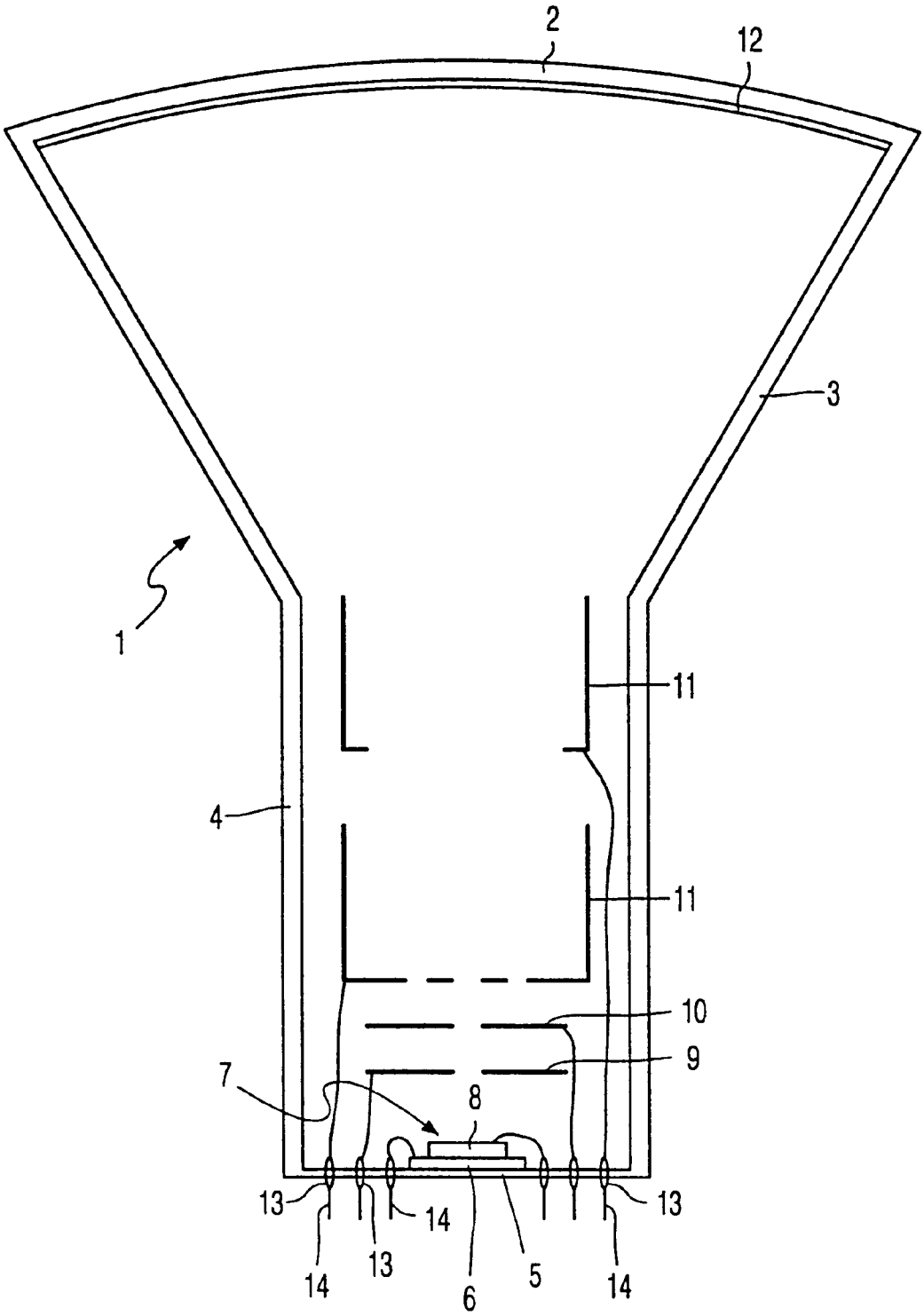
FIG. 1 shows an electron tube in accordance with the invention.

FIG. 1 schematically shows an electron tube 1, in this case a cathode ray tube used for displaying images. This electron tube comprises a display window 2, a cone 3 and an end portion 4 with an end wall 5. On the inner surface, at the location of the end wall 5, there is a support 6 on which, in this example, one or more semiconductor cathodes 7 having an emissive surface 8 are situated. The semiconductor cathode is avalanche breakdown type, such as described in U.S. Pat. No. 5,444,328.

The end portion 4 accommodates grid electrodes 9, 10 and further deflection electrodes 11. The cathode ray tube further comprises a phosphor screen 12 at the location of the display window. Other elements included in such a cathode ray tube, such as shadow masks etc., are not shown in FIG. 1 for the sake of simplicity. To enable, inter alia, the cathode and the accelerating electrodes to be electrically connected, the end wall 5 is provided with leadthroughs 13, via which the leads for these elements are electrically connected to connecting pins 14.

Figure 2:
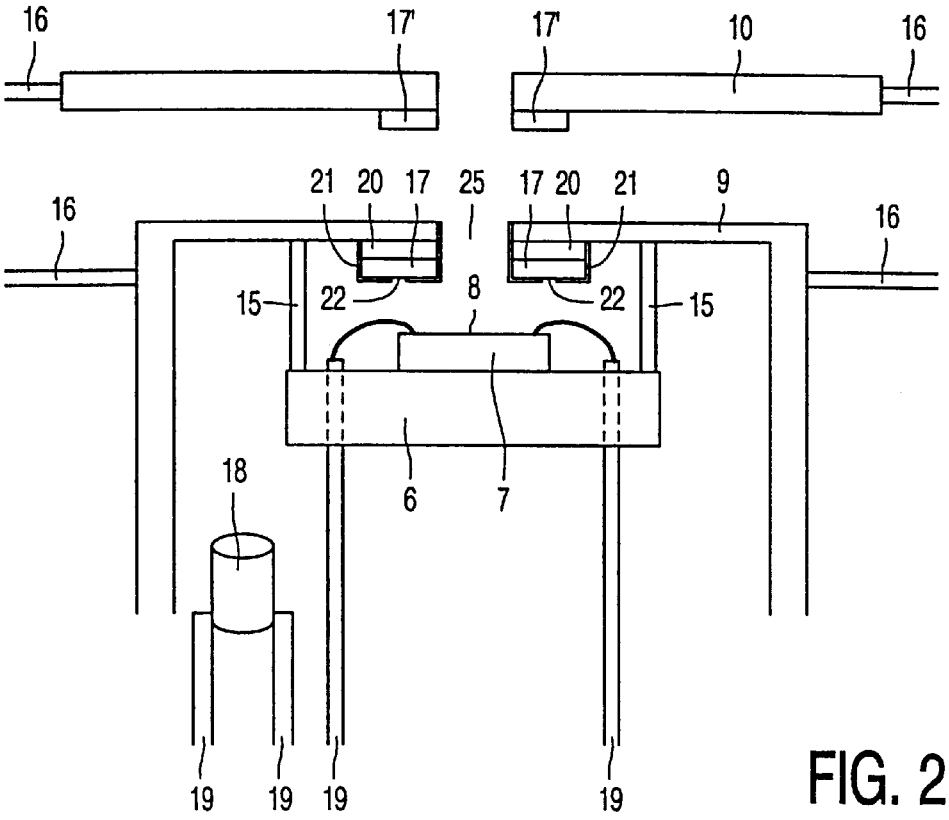
FIG. 2 schematically shows a part of FIG. 1.

FIG. 2 shows a possible construction of a part of an electron tube in accordance with the invention. The support 6 carrying the semiconductor cathode 7 is situated within a first grid 9 which is embodied so as to be a skirt. The support 6 is connected to the grid 9 via connecting elements 15. The grid 9, as well as a second grid 10, is secured in a larger assembly by means of clamping elements 16. In accordance with the invention, a cesium source 17 is situated opposite the emissive surface 8 of the cathode. In this example, the cesium source is secured on the side of the first grid 9 facing the cathode 8. The device further comprises a primary cesium source 18 which, in this example, is a cesium-chromate dispenser. Both the cesium-chromate dispenser and the cathode are electrically interconnected via connecting wires 19. For clarity, other electric contacts (for example of the grids 9, 10) are not shown in FIG. 2.

As mentioned in the opening paragraph, during the activation of the electron tube, cesium from the primary source 18 is evaporated to reduce the work function of the semiconductor cathode. During the life-time, cesium is lost;

reactivation of the primary source 18 is too expensive and requires too much energy, so that this is unacceptable for consumer applications.

A gold layer provided on the inner surface of the first grid 9 (for example by electrodeposition, sputtering or vapor deposition) absorbs, during said activation process, a part of the cesium, thereby forming a cesium-gold alloy (in this example $Cs_x$—$Au_y$). This gold layer is advantageously, although not necessarily, provided around the aperture 25 in the grid 9, preferably with a circular circumference. During the operation of the cathode, the cesium is slowly delivered again, thus ensuring a good dispensation of cesium. Since the temperature of the grid 9 increases (and hence the temperature of the cesium source) as a result of dissipation in the cathode, dispensation takes place as a result of evaporation. By virtue thereof, the cesium source has the important advantage that it does not have to be provided with heating wires.

The material used for the first grid 9 is, for example, a nickel-iron alloy, such as invar. To preclude that nickel from this alloy penetrates the gold and, for example, during the activation forms undesirable nickel oxides at the surface in vacuo, in this example, a protective layer or diffusion barrier 20, for example of molybdenum or platinum, is provided between the cesium source and the grid 9.

Figure 3:
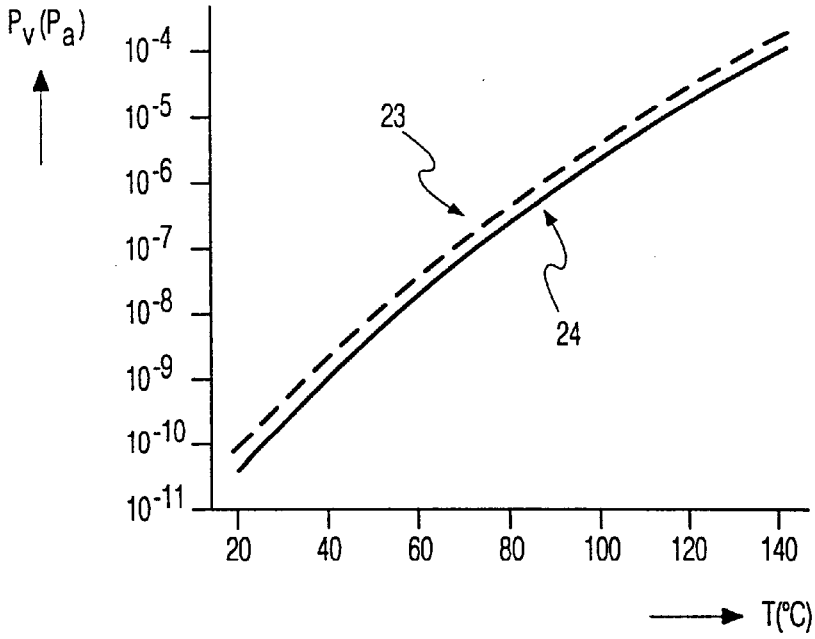
FIG. 3 shows, for a few compounds used, the vapor pressure as a function of the temperature.

The construction as a whole can be embodied so that, in practice, the temperature of the grid 9 during operation is practically limited to temperatures between 90° C. and 120° C. The graph of FIG. 3 shows that cesium auride (CsAu, curve 23) and cesium antimonide ($Cs_3Sb$, curve 24) exhibit in this range a vapor pressure ranging between approximately $10^{-5}$ Pa and $10^{-6}$ Pa, which is sufficient to ensure cesium dispensation.

The overall quantity of cesium from the cesium source 17 is not only determined by the dimensions of the source but also by the degree of binding of the cesium during the activation process. A suitable quantity of cesium can be bound by a gold or antimony layer having a thickness of at least 0.15 $\mu$m and a maximum diameter of the order of 0.2–20 mm; although, from the point of view of an accurate cesium delivery, the maximum diameter is limited to maximally 1 mm. In addition, surfaces situated at a larger distance from the tube axis contribute less to the dispensation, while they must form an alloy with cesium during the activation process.

The cesium delivery can be further regulated by enveloping the $Cs_x$—$Au_y$ or $Cs_x$–$Sb_y$ with a layer 21 of platinum or another material which cannot be penetrated by cesium, in which case cesium vapor is released through an aperture 22.

A possible second cesium source 17' may be situated, if necessary, on the inside of the grid 10. Dependent upon, inter alia, the aperture in the grid 9, the cesium source may alternatively be situated only on the grid 10.

What is claimed is:

1. An electron tube comprising a cathode structure for emitting electrons, which is arranged on a support, characterized in that a cesium source is situated in a space between the support and a grid electrode, which cesium source comprises an alloy of one or more of the combinations cesium-gold, cesium-antimony or cesium-gold-antimony.

2. An electron tube as claimed in claim 1, characterized in that the cesium source is situated in the space between the support and the grid electrode opposite said support.

3. An electron tube as claimed in claim 1, characterized in that, viewed in the direction of the axis of the electron tube, the cesium source is situated practically opposite the cathode structure.

4. An electron tube as claimed in claim 1, characterized in that the alloy is at least partly surrounded by a layer which is practically impenetrable to cesium.

5. An electron tube as claimed in claim 1, characterized in that the cathode structure is provided with a semiconductor device for generating electrons, comprising a semiconductor body of a semiconductor material having at least one structure for emitting electrons near a main surface of the semiconductor body, in which electrons can be generated by applying suitable electric voltages, which electrons leave the semiconductor body at the location of an emitting surface region.

6. An electron tube as claimed in claim 1, characterized in that the cesium source is provided as a thin layer on the side of a grid electrode facing the cathode structure, which grid electrode is situated opposite the support.

7. An electron tube as claimed in claim 6, characterized in that the thin layer has a thickness of at least 0.15 $\mu$m.

8. An electron tube as claimed in claim 6, characterized in that the cesium source has a maximum diameter of 2 mm.

9. An electron tube as claimed in claim 1, characterized in that a diffusion-inhibiting material is situated between the cesium source and the grid electrode.

* * * * *